US010589280B2

(12) United States Patent
Arima et al.

(10) Patent No.: US 10,589,280 B2
(45) Date of Patent: Mar. 17, 2020

(54) MILL ROLLER AND PULVERIZER

(71) Applicant: MITSUBISHI HITACHI POWER SYSTEMS, LTD., Kanagawa (JP)

(72) Inventors: Kenichi Arima, Tokyo (JP); Shinji Matsumoto, Tokyo (JP); Takuichiro Daimaru, Tokyo (JP); Kazushi Fukui, Yokohama (JP); Daisuke Ishimoto, Yokohama (JP); Hideyuki Hamaya, Yokohama (JP); Hidechika Uchida, Yokohama (JP); Norichika Kai, Nagasaki (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 246 days.

(21) Appl. No.: 15/555,632

(22) PCT Filed: Nov. 24, 2015

(86) PCT No.: PCT/JP2015/082875

§ 371 (c)(1),
(2) Date: Sep. 5, 2017

(87) PCT Pub. No.: WO2016/166917

PCT Pub. Date: Oct. 20, 2016

(65) Prior Publication Data

US 2018/0050342 A1 Feb. 22, 2018

(30) Foreign Application Priority Data

Apr. 17, 2015 (JP) ..... 2015-085220

(51) Int. Cl.
*B02C 15/00* (2006.01)
*B02C 15/04* (2006.01)

(52) U.S. Cl.
CPC ..... *B02C 15/004* (2013.01); *B02C 15/04* (2013.01)

(58) Field of Classification Search
CPC ..... B02C 15/04
(Continued)

(56) References Cited

U.S. PATENT DOCUMENTS 2,304,326 A * 12/1942 Adams ..... B02C 15/04 241/109
4,606,506 A 8/1986 Okada et al.
(Continued)

FOREIGN PATENT DOCUMENTS

CN 100563834 12/2009
JP 2685820 12/1997
(Continued)

OTHER PUBLICATIONS

International Search Report dated Feb. 23, 2016 in International (PCT) Application No. PCT/JP2015/082875.
(Continued)

*Primary Examiner* — Faye Francis
(74) *Attorney, Agent, or Firm* — Wenderoth, Lind & Ponack, L.L.P.

(57) ABSTRACT

A mill roller (6) is provided with a roller main body (62) that rotates about an inclined axis line (O2) and has an outer peripheral surface (64) for pulverizing an object to be crushed against the mill table (4). The outer peripheral surface (64) is convex outward in a radial direction of the roller main body (62). The outer peripheral surface (64) has a first outer peripheral surface (641) and a second outer peripheral surface (642). The first outer peripheral surface (641) has an arcuate shape formed to have the same radius of curvature on both sides of a maximum outer diameter point (A). The second outer peripheral surface (642) is further receded inward in the radial direction than an imaginary circle running along the first outer peripheral surface (641).

6 Claims, 5 Drawing Sheets

(58) Field of Classification Search
USPC ..... 241/119
See application file for complete search history.

(56) References Cited

U.S. PATENT DOCUMENTS

| | | | | |
|---|---|---|---|---|
| 6,138,933 | A * | 10/2000 | Chevalier | B02C 15/06 241/228 |
| 6,824,088 | B2 * | 11/2004 | Robinson | B02C 15/007 241/121 |
| 7,866,584 | B2 * | 1/2011 | Guerrero Palma | B02C 15/004 241/117 |
| 2002/0162909 | A1 | 11/2002 | Robinson | |
| 2009/0039187 | A1 * | 2/2009 | Guerrero Palma | B02C 15/003 241/110 |
| 2009/0121060 | A1 * | 5/2009 | Chen | B02C 15/003 241/110 |
| 2010/0181401 | A1 * | 7/2010 | Hanghoj | B02C 15/004 241/107 |
| 2011/0121116 | A1 * | 5/2011 | Scholz | B02C 15/004 241/227 |
| 2013/0061787 | A1 | 3/2013 | Iida et al. | |
| 2013/0175378 | A1 * | 7/2013 | Kawatsu | B02C 15/004 241/117 |

FOREIGN PATENT DOCUMENTS

| | | |
|---|---|---|
| JP | 2000-24532 | 1/2000 |
| JP | 2000-354778 | 12/2000 |
| JP | 2002-119877 | 4/2002 |
| JP | 2002-320869 | 11/2002 |
| JP | 3524050 | 4/2004 |
| JP | 4101709 | 6/2008 |
| JP | 2011-245357 | 12/2011 |
| JP | 2012-228693 | 11/2012 |

OTHER PUBLICATIONS

Written Opinion of the International Searching Authority dated Feb. 23, 2016 in International (PCT) Application No. PCT/JP2015/082875.

* cited by examiner

MILL ROLLER AND PULVERIZER

TECHNICAL FIELD

The present invention relates to a mill roller and pulverizer.

This application claims priority based on Japanese Patent Application No. 2015-085220 filed in Japan on Apr. 17, 2015, of which the contents are incorporated herein by reference.

BACKGROUND ART

Roller mills are used to pulverizing fuel coal into pulverized coal. The roller mills are a pulverizer using a roller. The roller mills have a rotatably driven table and a plurality of rollers disposed so as to be rotatably attached facing the table.

The roller mills are disclosed in Patent Literature 1 to Patent Literature 4. With the roller mills described in Patent Literature 1 to Patent Literature 4, an outer peripheral surface with a curved roller main body of a roller is disposed in a condition forming a gap with an upper surface of the curved table. The roller main body and table rotate, and therefore, the roller mill pulverizes an object to be crushed such as coal or the like by causing to be interposed in the gap between the outer peripheral surface of the roller main body and upper surface of the table.

CITATION LIST

Patent Literature

Patent Literature 1: JP-A-2000-024532
Patent Literature 2: JP-A-2000-354778
Patent Literature 3: JP-A-2002-119877
Patent Literature 4: JP-B-4101709

SUMMARY OF INVENTION

Technical Problems

Incidentally, with the aforementioned roller mill, the outer peripheral surface of the roller main body and upper surface of the table wear by continuously pulverizing an object to be crushed. As a result, an interval between the outer peripheral surface of the roller main body and table surface which is an upper surface of the table will widen. The pulverizing performance of the roller mill will be reduced due to the interval widening. Therefore, when the interval widens due to wearing in the roller mill, reduction of the pulverizing performance must be suppressed by periodically moving the roller main body such that the outer peripheral surface is close to the table and adjusting so as to reduce the interval.

However, if the outer peripheral surface of the roller main body is curved, a central vicinity of the outer peripheral surface wears more than an end portion of the outer peripheral surface. As a result, when the roller main body is moved to reduce the distance from the table in order to reduce the interval widened due to wearing, even if a central vicinity of the outer peripheral surface with a high amount of wear is brought closer to the table, an end portion of the outer peripheral surface with a low amount of wear will contact the table. Therefore, the roller main body cannot be sufficiently brought closer to the table, and thus a required pulverizing performance may not be achieved.

The present invention provides a roller main body and pulverizer that can achieve required pulverizing performance.

Solution to Problem

In order to solve the aforementioned problems, the present invention proposes the following means.

A mill roller according to a first aspect of the present invention includes a roller main body having an outer peripheral surface, the roller main body rotating about an axis line, and pulverizing an object to be crushed against a table surface of a mill table, where the outer peripheral surface has: a first outer peripheral surface that is curved so as to form a convex shape outward in a radial direction orthogonal to the axis line of the roller main body, and having an arcuate shape formed with the same radius of curvature on both sides of a maximum outer diameter point in a cross section including the axis line; and a second outer peripheral surface formed on at least one end portion in an axial direction of the first outer peripheral surface, connected to an end surface facing an axial direction of the roller main body, and receded further inward in the radial direction of an imaginary circle than an imaginary circle running along the first outer peripheral surface.

Based on this configuration, the second outer peripheral surface can be further receded inward in advance in a radial direction as compared to the first outer peripheral surface. Thereby, even if the wear amount of a region where the second outer peripheral surface is formed is low, the second outer peripheral surface can be suppressed from approaching the table surface side more than a region where the first outer peripheral surface with a high amount of wear is formed. Therefore, even if wearing of the first outer peripheral surface advances, the first outer peripheral surface of the outer peripheral surfaces can be maintained in a condition nearest to the table surface. Therefore, the roller main body can be moved such that the interval between the first outer peripheral surface and table surface is brought closer to predetermined value, without being affected by an end portion in an axial direction of the outer peripheral surface on which the second outer peripheral surface is formed.

A mill roller according to a second aspect is similar to the first aspect, wherein the second outer peripheral surface is formed at a width of from 10% to 30% with regard to a width in the axial direction of the entire outer peripheral surface, in a cross section including the axis line.

Based on this configuration, the first outer peripheral surface with a width for maintaining pulverizing performance can be formed while forming the second outer peripheral surface. Thereby, the second outer peripheral surface can be formed without reducing the pulverizing performance by the roller main body.

A mill roller according to a third aspect is similar to the first or second aspect, wherein the second outer peripheral surface is curved so as to form a convex shape facing outward in a radial direction of the roller main body, and formed such that a roller curvature ratio which is a ratio of a radius of curvature with regard to a roller diameter which is a width in the axial direction of the roller main body is smaller than a roller curvature of the first outer peripheral surface.

Based on this configuration, the second outer peripheral surface can be further receded inward in advance in a radial direction than the first outer peripheral surface.

A mill roller according to a fourth aspect is similar to the third aspect, wherein the roller curvature ratio of the first outer peripheral surface is 0.45 or less, and the roller curvature ratio of the second outer peripheral surface is 0.2 or less.

Based on this configuration, the second outer peripheral surface can recede more precisely than the first outer peripheral surface while suppressing reduction of the pulverizing performance by the first outer peripheral surface.

A mill roller according to a fifth aspect is similar to the first or second aspect, wherein the second outer peripheral surface may form a straight line shape in a cross section including the axis line.

Based on this configuration, the second outer peripheral surface can be easily formed by chamfering an end portion of the outer peripheral surface.

A pulverizer according to a sixth aspect of the present invention includes: the mill roller of any one of a first aspect to fifth aspect; and a mill table rotatably supported and pulverizing the object to be crushed between the table surface and the outer peripheral surface of the mill roller.

Advantageous Effects of Invention

According to the present invention, an outer peripheral surface has a second outer peripheral surface, and therefore, the roller main body can be sufficiently brought closer to a mill table, and thus a required pulverizing performance can be achieved.

BRIEF DESCRIPTION OF DRAWINGS

FIG. 3 are graphs describing changes over time when the mill roller of the embodiment of the present invention is used.

DESCRIPTION OF EMBODIMENTS

First Embodiment

A pulverizer 1 of a first embodiment according to the present invention is described while referring to FIGS. 1 to 4.

Figure 1:
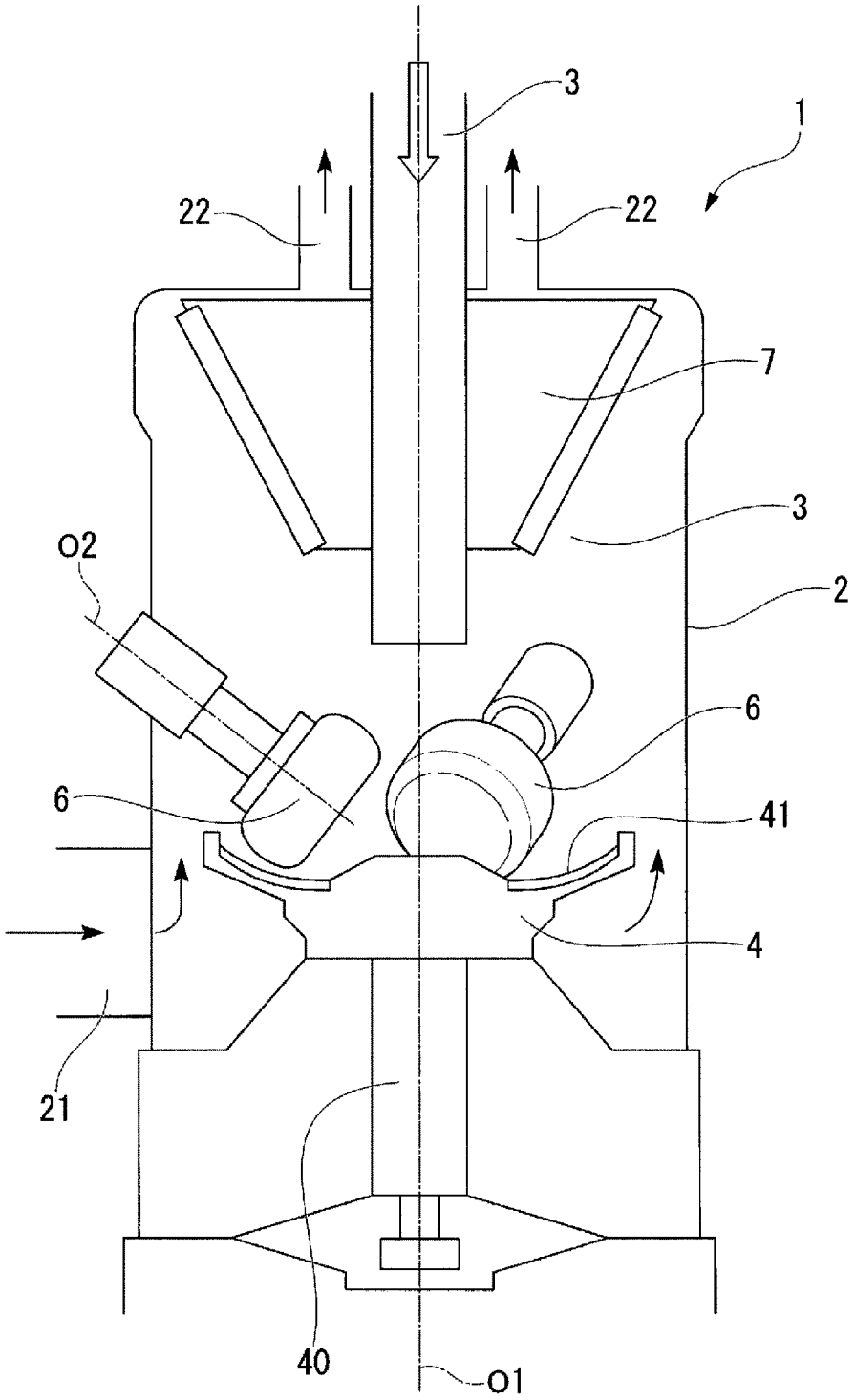
FIG. 1 is a schematic configuration diagram of a pulverizer of an embodiment of the present invention.

The pulverizer 1 is an upright roller mill used for pulverizing a bulky object to be crushed such as coal, petroleum coke, or the like for a land boiler or integrated coal gasification combined cycle system (IGCC). As illustrated in FIG. 1, the pulverizer 1 of the present embodiment has a housing 2, a raw material supply tube 3, a mill table 4, a plurality of mill rollers 6, and a rotary separator (rotary separator) 7. The raw material supply tube 3 penetrates inside the housing 2 from above in a vertical direction. The mill table 4 is provided inside the housing 2. The mill roller 6 pulverizes an object to be crushed in cooperation with the mill table 4. The rotary separator 7 is provided above the mill table 4 inside the housing 2.

The housing 2 forms a substantially cylindrical hollow shape about a central axis line O1 along a vertical direction. The housing 2 provides an inlet port 21 that feeds primary air from outside. The inlet port 21 is provided to a side of the mill table 4 provided below in a vertical direction. The housing 2 has an outlet port 22 that discharges a pulverized object to be crushed along with primary air fed from the inlet port 21, which is provided above in a vertical direction. In other words, a flow channel of primary air flowing from the inlet port 21 to the outlet port 22 is demarcated inside the housing 2.

The raw material supply tube 3 is a tubular member that introduces an object to be crushed such as coal or the like supplied from a supply source not illustrated in the drawing into the housing 2 from above in a vertical direction. The raw material supply tube 3 is disposed at a center position of the housing 2, and extends in a vertical direction along the central axis line O1. The raw material supply tube 3 is disposed penetrating an upper portion of the housing 2. An opened lower end portion of the raw material supply tube 3 is disposed near a center of the housing 2 in a vertical direction.

An object to be crushed such as coal or the like is placed on the mill table 4. The mill table 4 is disposed below in a vertical direction inside the housing 2, on the same axis as the raw material supply tube 3. The mill table 4 is rotatably supported on a table shaft 40 mounted on the housing 2. The table shaft 40 can be rotated about the central axis line O1 by the table shaft 40 in a vertical direction. The mill table 4 has a table surface 41 disposed to be concentric to the central axis line O1 on an upper surface in a vertical direction.

The table surface 41 is a curved surface that forms an annular shape about the central axis line O1. The table surface 41 is formed to be curved so as to correspond with an outer peripheral surface 64 of a mill roller 6 described later. The table surface 41 inclines to be higher toward an outer peripheral side of the mill table 4 moving away from the central axis line O1.

The rotary separator 7 classifies an object to be crushed that has been pulverized by the mill table 4 and mill roller 6. The rotary separator 7 is provided above in a vertical direction inside the housing 2. The rotary separator 7 is provided below the outlet port 22 so as to surround the raw material supply tube 3. The rotary separator 7 can be rotated by a drive device (not illustrated in the drawing).

Figure 2:
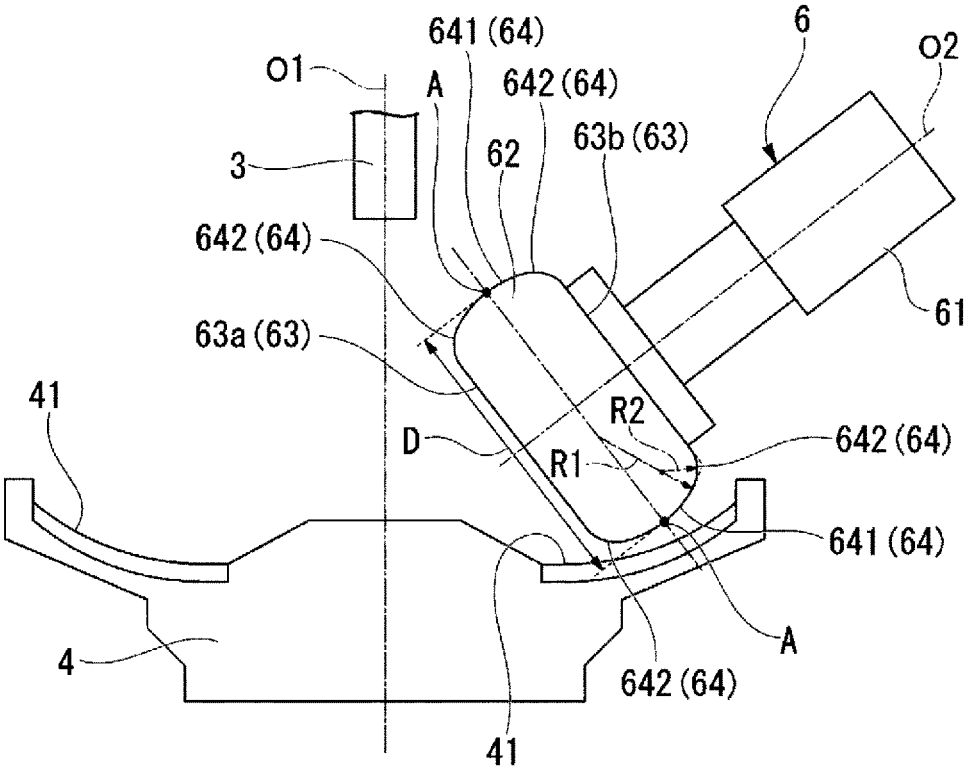
FIG. 2 is an enlarged view describing a mill roller of a first embodiment of the present invention.

The mill roller 6 operates in conjunction with the rotation of the mill table 4, and rotates about an inclined axis line O2 to pulverize an object to be crushed by a pressing force against the table surface 41 of the mill table 4. Herein, the inclined axis line O2 of the present embodiment is a center line around which a roller main body 62 described later rotates. The inclined axis line O2 is an axial line extending in an inclined manner downward in a vertical direction with regard to a horizontal direction, toward the central axis line O1. A plurality (for example, three in the present embodiment) of the mill rollers 6 of the present embodiment are concentrically disposed at equal intervals about the central axis line O1. As illustrated in FIG. 2, the mill roller 6 has a rotatable roller shaft 61 and a roller main body 62 connected to a tip end of the roller shaft 61.

The roller shaft 61 is rotatable about the inclined axis line O2 by a drive device (not illustrated in the drawing), above in a vertical direction of the mill table 4. The roller shaft 61 extends diagonally downward in a vertical direction with regard to a horizontal direction toward the central axis line O1 such that a tip end approaches the mill table 4.

The roller main body 62 pulverizes an object to be crushed between the outer peripheral surface 64 and table surface 41 of the mill table 4 by rotating about the inclined axis line O2. The roller main body 62 is connected to a tip end of the roller shaft 61 and rotates by the roller shaft 61 rotating. The roller main body 62 forms a cylindrical shape about the inclined axis line O2. The roller main body 62 has an end surface 63 facing an axial direction in which the inclined axis line O2 extends, and an outer peripheral surface 64 that pulverizes an object to be crushed against the table surface 41 of the mill table 4.

The end surface 63 is a flat surface expanding in a radial direction which is a direction orthogonal to the inclined axis line O2, facing an axial direction. The end surface 63 has an inner end surface 63*a* on a side near the mill table 4, and an outer end surface 63*b* on a side near the roller shaft 61.

The outer peripheral surface 64 is a surface facing a radial direction of the roller main body 62. The outer peripheral surface 64 faces the table surface 41 of the mill table 4 with an interval therebetween. The outer peripheral surface 64 has a first outer peripheral surface 641 and second outer peripheral surface 642. The first outer peripheral surface is curved so as to form a convex shape outward in a radial direction of the roller main body 62. The second outer peripheral surface 642 is formed on at least one end portion in an axial direction of the first outer peripheral surface 641.

The first outer peripheral surface 641 has an arcuate shape formed by the same radius of curvature R1 on both sides of a maximum outer diameter point A in a cross section including the inclined axis line O2. The first outer peripheral surface 641 is disposed at a position separated from the table surface 41 of the mill table 4 at only a predetermined value $\alpha$ in order to form an interval appropriate for efficiently pulverizing an object to be crushed. The first outer peripheral surface 641 of the present embodiment is a surface facing outward in a radial direction, extending in an axial direction about a maximum outer diameter point A, in a cross section including the inclined axis line O2. The first outer peripheral surface 641 is formed to form a cylindrical shape about the inclined axis line O2. The first outer peripheral surface 641 is formed by a radius of curvature R1 corresponding to the table surface 41. The first outer peripheral surface 641 preferably has an arcuate shape with a 0.45 or less roller curvature ratio which is a ratio of the radius of curvature R1 with regard to a roller diameter D which is a width in an axial direction of the roller main body 62, in a cross section including the inclined axis line O2. The first outer peripheral surface 641 more preferably has an arcuate shape with a from 0.25 to 0.35 roller curvature ratio.

Herein, the maximum outer diameter point A is a position farthest away from the inclined axis line O2 in a radial direction in the outer peripheral surface 64. In other words, in the maximum outer diameter point A, the outer peripheral surface 64 protrudes most outward in a radial direction. The maximum outer diameter point A of the present embodiment is formed about an axial direction of the outer peripheral surface 64. Therefore, if the interval between the outer peripheral surface 64 and table surface 41 is set to the predetermined value $\alpha$ in order to efficiently pulverize an object to be crushed, the interval between the table surface 41 and first outer peripheral surface 641 formed on both sides of maximum outer diameter point A most protruding outward in a radial direction in the outer peripheral surface 64 is established. In other words, the pulverizing performance when pulverizing an object to be crushed by interposing between the table surface 41 and outer peripheral surface 64 is set by the position of the first outer peripheral surface 641 with regard to the table surface 41.

The second outer peripheral surface 642 is formed on both ends in an axial direction of the first outer peripheral surface 641. The second outer peripheral surface 642 is connected to the inner end surface 63*a* and outer end surface 63*b*. In other words, the second outer peripheral surface 642 is formed on both end portions in an axial direction of the outer peripheral surface 64. The second outer peripheral surface 642 configures a corner portion of the roller main body 62 in conjunction with an inner end surface 63*a* and outer end surface 63*b*. The outer peripheral surface 642 is formed so as to further recede inwards in a radial direction of an imaginary circle than the imaginary circle of the radius of curvature R1 along the first outer peripheral surface 641. The second outer peripheral surface 642 of the present embodiment is curved so as to form a convex shape outward in a radial direction of the roller main body 62, similar to the first outer peripheral surface, in a cross section including the inclined axis line O2. The second outer peripheral surface 642 is formed such that a radius of curvature R2 is smaller than the radius of curvature R1 of the first outer peripheral surface 641. Specifically, the second outer peripheral surface 642 on one side in an axial direction is formed so as to have a width of from 10% to 30% of a length in an axial direction of the entire outer peripheral surface 64 in a cross section including the inclined axis line O2. In other words, in the present embodiment, the second outer peripheral surface 642 is formed at a width of from 20% to 60% combining both sides in an axial direction with regard to a length in an axial direction of the entire outer peripheral surface 64. In the present embodiment, the first outer peripheral surface 641 is formed at a width of from 40% to 80% of a central vicinity in an axial direction with regard to a length in an axial direction of the entire outer peripheral surface 64, in a cross section including the inclined axis line O2. The second outer peripheral surface 642 preferably has an arcuate shape with a 0.2 or less roller curvature ratio which is a ratio of the radius of curvature R2 with regard to the roller diameter D. The second outer peripheral surface 642 more preferably has an arcuate shape with a from 0.05 to 0.15 roller curvature ratio.

In the aforementioned pulverizer 1, an object to be crushed is supplied from the raw material supply tube 3, and the object to be crushed drops onto the mill table 4. The mill table 4 and roller main body 62 rotate, and therefore, the object to be crushed on the mill table 4 advances into a gap formed between the table surface 41 of the mill table 4 and the outer peripheral surface 64 of the roller main body 62. The object to be crushed advancing into the gap is pressed and pulverized into powder as pulverized coal, by the object to be crushed interposing between the outer peripheral surface 64 and table surface 41. The powdery object to be crushed is ejected to an outer peripheral portion of the mill table 4, and then raised while drying by primary air introduced from the inlet port 21 of a lower portion. Of the raised powdery object to be crushed, coarse powder classified by the rotary separator 7 is dropped, returned again to the mill table 4, and the repulverized. On the other hand, of the pulverized coal, fine powder classified by the rotary separator 7 passes through the rotary separator 7, and then discharged from the outlet port 22 by riding an airflow.

Figure 3A:
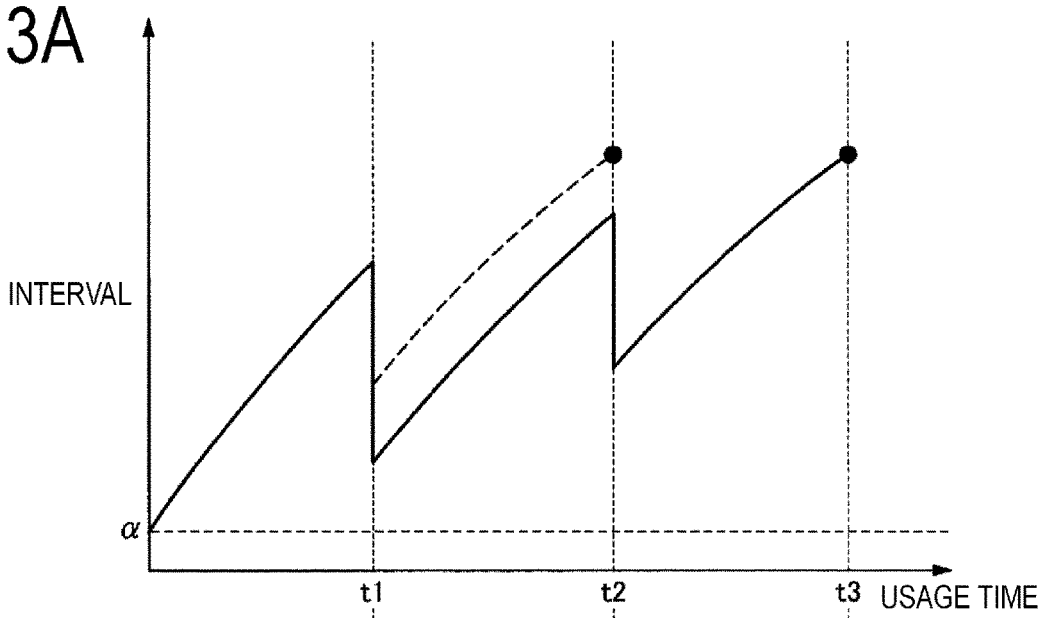
FIG. 3A is a graph showing the relationship between the usage time of a pulverizer and interval between the outer peripheral surface of the mill roller and table surface of the mill table.

If an object to be crushed is continuously pulverized by the mill roller 6 and mill table 4, the usage time of the pulverizer 1 increases, and therefore, the outer peripheral surface 64 of the roller main body 62 wears. Not only the outer peripheral surface 64 of the roller main body 62 but the table surface of the mill table 4 also wears. Therefore, the interval between the table surface 41 and outer peripheral surface 64 gradually expands from a predetermined value α as shown in FIG. 3A, in accordance with the passing usage time of the pulverizer 1. As the distance expands, a roller lift of the mill roller 6 is reduced and the pressing force to the object to be crushed by the roller main body 62 is reduced. As a result, the mill capacity which is the pulverizing capacity at the same mill power is reduced, and the pulverizing performance is reduced.

Figure 3B:
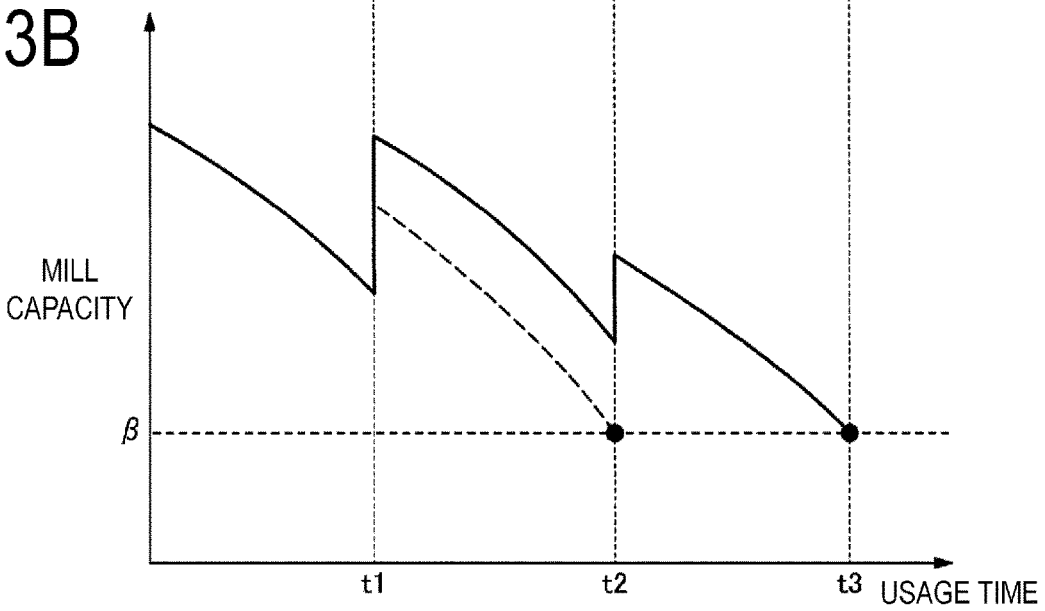
FIG. 3B is a graph showing the relationship between the mill capacity and usage time of the pulverizer.

Therefore, at a point in time when a time t1 where the usage time of the pulverizer 1 is predetermined has passed, the position of the mill roller 6 with regard to the mill table 4 is adjusted such that the interval between the table surface 41 and outer peripheral surface 64 approach the predetermined value α. Thereby, the interval between the table surface 41 and outer peripheral surface 64 can be brought closer to the predetermined value α, the roller lift can be maintained, and the pressing force on an object to be crushed by the roller main body 62 can be maintained. As a result, as shown in FIG. 3B, the mill capacity can be recovered and reduction of the pulverizing performance can be suppressed with the pulverizer 1.

Figure 4:
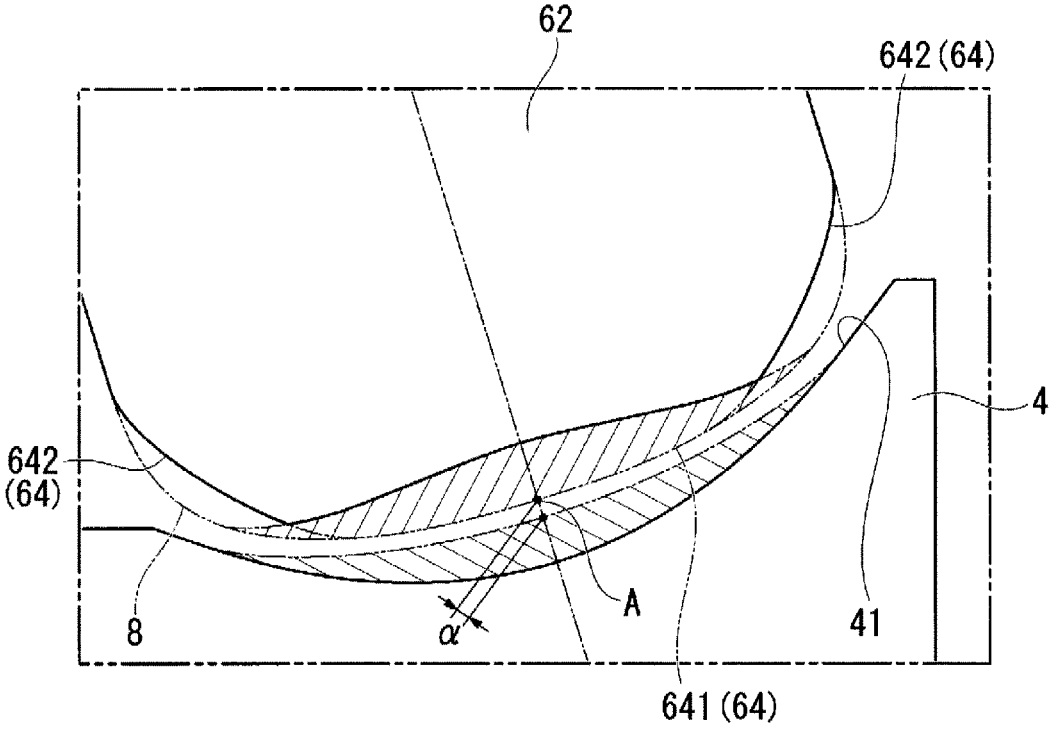
FIG. 4 is an enlarged view of the essentials parts comparing the differences between the shapes of the mill roller of the embodiment of the present invention and a mill roller that does not have a second outer peripheral surface.

However, as illustrated in FIG. 4, the first outer peripheral surface 641 wears more than the second outer peripheral surface 642 in the outer peripheral surface 64. In other words, if the second outer peripheral surface 642 is not provided and the outer peripheral surface 64 is formed only by an imaginary curved surface 8 of the same radius of curvature R1 as the first outer peripheral surface 641, the amount of wear in the central vicinity in an axial direction is larger as compared to both end portions in an axial direction of the outer peripheral surface 64. As a result, the interval between the outer peripheral surface 64 and table surface 41 expands most at a central vicinity in axial direction of the outer peripheral surface 64. If the position of the roller main body 62 is adjusted in order to bring the interval between the table surface 41 and central vicinity in an axial direction of the outer peripheral surface 64 with the widest interval closer to the predetermined value α, an inner end portion in an axial direction of the outer peripheral surface 64 may contact the table surface 41. As a result, as shown by the dotted line in FIG. 3A, the interval between the table surface 41 and outer peripheral surface 64 cannot be sufficiently brought closer to the predetermined value α. Therefore, the mill capacity cannot be sufficiently recovered as shown by the dotted line in FIG. 3B. As a result, the mill capacity will be at or lower than a mill capacity lower limit value β, which is an allowable value for maintaining the performance of the pulverizer 1 for a short usage time. If lower than the mill capacity lower limit value β, a pulverizing performance required for the pulverizer 1 cannot be demonstrated. Therefore, the roller main body 62 and mill table 4 must be replaced.

However, according to the pulverizer 1 and mill roller 6 of the present embodiment, both end portions in an axial direction of the outer peripheral surface 64 further recede in advance in a radial direction based on the second outer peripheral surface 642 than the first outer peripheral surface 641. Thereby, even if the wear amount of a region where the second outer peripheral surface 642 is formed is low, the second outer peripheral surface 642 can be suppressed from approaching the table surface 41 side more than a region where the first outer peripheral surface 641 with a high amount of wear is formed. Therefore, even if wearing of the first outer peripheral surface 641 advances, the first outer peripheral surface 641 of the outer peripheral surfaces 64 can be maintained in a condition nearest to the table surface 41. In other words, even if the amount of wear of both end portions in an axial direction of the outer peripheral surface 64 is low, both end portions can be suppressed from approaching the table surface 41 more than a central vicinity in an axial direction of the outer peripheral surface 64 with a high amount of wear. As a result, as shown by the solid line in FIG. 3A, the roller main body 62 can be moved such that the interval between the first outer peripheral surface 641 and table surface 41 is brought closer to predetermined value α, without being affected by both end portions in an axial direction of the outer peripheral surface 64 on which the second outer peripheral surface 642 is formed, in time t1. As a result, the mill capacity of the pulverizer 1 can be largely recovered in time t1, as shown by the solid line in FIG. 3B. Therefore, the outer peripheral surface 64 has the second outer peripheral surface 642, and therefore, the roller main body 62 can be sufficiently brought closer to the table, and a required pulverizing performance can be achieved.

The roller main body 62 can be moved and the mill capacity of the pulverizer 1 can be recovered, such that the interval between the first outer peripheral surface 641 and table surface 41 is brought closer to the predetermined value α in time t1. Thereby, the usage time of the pulverizer 1 can be improved as with times t2, t3, as shown in FIG. 3. Therefore, the time until replacing roller main body 62 and mill table 4 can be extended. As a result, the lifespan of the roller main body 62 and mill table 4 can be improved.

The second outer peripheral surface 642 is formed at from 10% to 30% of a length in an axial direction of the entire outer surface 64 in a cross section including the inclined axis line O2, on one end portion in an axial line direction. Therefore, the first outer peripheral surface 641 including the maximum outer diameter point A can be formed at approximately 40% of a length in an axial direction of the entire outer peripheral surface 64. Therefore, while forming the second outer peripheral surface 642, the first outer peripheral surface 641 at a minimum width required for maintaining pulverizing performance can be formed. Thereby, the second outer peripheral surface 642 can be formed without reducing the pulverizing performance by the roller main body 62.

The second outer peripheral surface 642 is formed as a curved surface with a smaller radius of curvature than the first outer peripheral surface 641. Thereby, the second outer peripheral surface 642 can be formed with high precision as a surface further receding inward in a radial direction than the first outer peripheral surface 641. Therefore, if the first outer peripheral surface 641 is worn down, the second outer peripheral surface 642 can be suppressed from protruding outward in a radial direction and approaching the table surface 41, as compared to the first outer peripheral surface 641.

The roller curvature ratio of the first outer peripheral surface 641 is set to 0.45 or less and the roller curvature ratio of the second outer peripheral surface 642 is set to 0.2 or less. Therefore, the second outer peripheral surface 642 can recede more precisely than the first outer peripheral surface 641 while suppressing reduction of the pulverizing performance by the first outer peripheral surface 641.

In particular, the roller curvature ratio of the first outer peripheral surface 641 is set to from 0.25 to 0.35 and the roller curvature ratio of the second outer peripheral surface 642 is set to from 0.05 to 0.15. Thereby, the second outer peripheral surface 642 can recede even more precisely than the first outer peripheral surface 641 while further suppressing reduction of the pulverizing performance by the first outer peripheral surface 641.

The second outer peripheral surface 642 is formed on both sides and not only one side in an axial direction of the first outer peripheral surface 641. Therefore, the second outer peripheral surface 642 can be symmetrically formed with regard to the first outer peripheral surface 641. Of the outer peripheral surfaces of the roller main body 62, the inner end surface 63*a* which is on a central axis line O1 side of the mill table 4 in a horizontal direction has a higher amount of wear than the outer end surface 63*b*. However, the second outer peripheral surface 642 is formed on both sides of the first outer peripheral surface 641. Thereby, even if the second outer peripheral surface 642 on the inner end surface 63*a* side is worn down due to long-term use, the roller main body 62 is reversed, and therefore, the second outer peripheral surface 642 on the outer end surface 63*b* side can be disposed on the central axis line O1 side of the mill table 4 in a horizontal direction, thereby making continued use possible.

Herein, differences in performance in an example and comparative example of the mill roller 6 will be described.

The example is the mill roller 6 of the aforementioned embodiment, where the outer peripheral surface 64 has the first outer peripheral surface 641 and second outer peripheral surface 642. The comparative example is the mill roller 6 formed by only the imaginary curved surface 8 of the same radius of curvature R1 as the first outer peripheral surface 641, where the outer peripheral surface 64 does not have the second outer peripheral surface 642.

TABLE 1

| | Comparative Example | Example |
|---|---|---|
| Coal feeding rate [t/h] | 2.0 | 2.0 |
| Fineness [%] (200 # pass) | 80 | 80 |
| Mill power ratio [-] | 1.0 | 1.0 |
| Table differential power ratio [-] | 1.0 | 1.0 |
| Roller lift ratio[-] | 1.0 | 1.0 |

Table 1 shows the roller lift and pulverizing performance of the mill rollers 6 of the comparative example and example. The coal feeding rate in Table is the amount of coal per unit time supplied from the raw material supply tube 3 to the mill table 4. The fineness is a value expressing the degree of fineness of coal after being pulverized by the mill table 4 and mill roller 6. The table differential pressure is a value expressing pulverizing performance, and expresses the circulation amount of coal after being pulverized based on a difference in pressure above and below the mill table 4.

As shown in FIG. 1, if the coal feeding rate, fineness, and mill power ratio are set with the same conditions in the example and comparative example, the roller lift and table differential pressure were observed to have almost no change. Therefore, even if the second outer peripheral surface 642 is provided on both sides in an axial direction of the first outer peripheral surface 641 as with the example, a difference in pulverizing performance compared to a case of only using the imaginary curved surface 8 as with the comparative example was found to not occur.

TABLE 2

| | | Coal Feeding Rate 2.0 t/h | | Coal Feeding Rate 2.5 t/h |
|---|---|---|---|---|
| | | 200 # pass 80% | 200 # pass 85% | 200 # pass 85% |
| Comparative Example | When New | 1.0 | 1.0 | 1.0 |
| | When Worn | 1.2 | 1.2 | 1.2 |
| Example | When New | 1.0 | 1.0 | 1.0 |
| | When Worn | 1.10 | 1.08 | 1.10 |

Table 2 shows the mill power ratio when worn with regard to when new of the mill roller 6 of the comparative example and example. "When Worn" in Table 2 expresses a condition where the outer peripheral surface 64 is worn by only a predetermined amount of wear with regard to the roller diameter D in the roller main body 62. "When Worn" in the present embodiment is a condition where the amount of wear is 10 mm, which is approximately 2.5% of the roller diameter D when the roller diameter D is 400 mm.

As shown in Table 2, the ratio of the mill power when worn with regard to when new is seen to be kept lower in the example as compared to the comparative example. In other words, the ratio of increase of the mill power when worn is seen to be lower in the example as compared to the comparative example. Therefore, even if a large load is not applied onto the mill roller 6 or mill table 4, an object to be crushed can be pulverized, and the amount of wear can be reduced. Thereby, the usage time of the pulverizer 1 is improved, and thus the lifespan of the roller main body 6 and mill table 4 can be improved.

Second Embodiment

Figure 5:
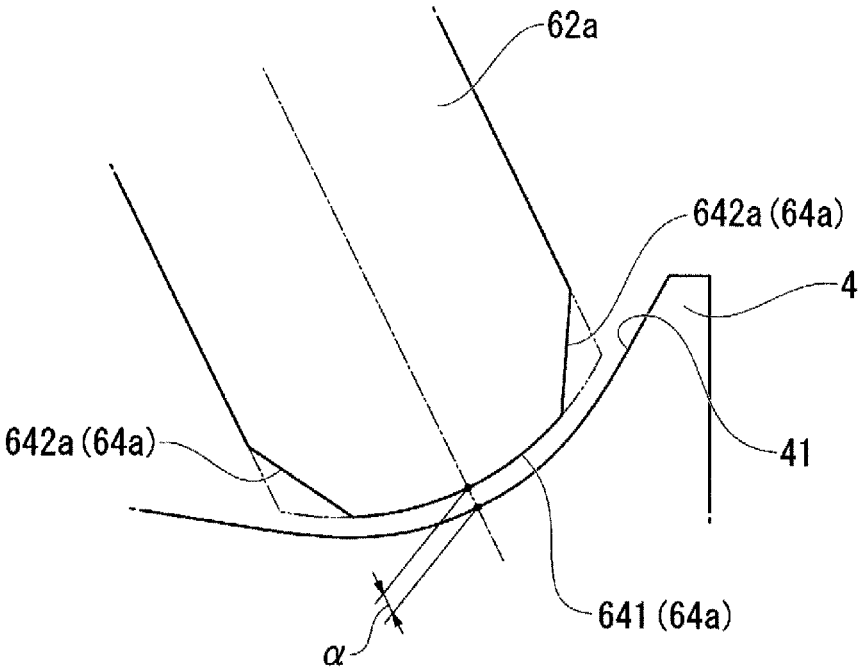
FIG. 5 is an enlarged view of a required portion describing a mill roller according to a second embodiment of the present invention.

A mill roller 6*a* of a second embodiment is described next while referring to FIG. 5.

Constituent elements of the second embodiment which are the same as the first embodiment are denoted with the same symbol, and detailed descriptions thereof are omitted. The mill roller 6*a* in the second embodiment is different from the first embodiment for the configuration of the second outer peripheral surface of the roller main body.

In other words, in the second embodiment, a second outer peripheral surface 642*a* is formed on both sides in an axial direction of the first outer peripheral surface 641 in a cross section including the inclined axis line O2. The second outer peripheral surface 642*a* forms a straight line shape from both ends in an axial direction of the first outer peripheral surface 641 in a cross section including the inclined axis line O2. In other words, the second outer peripheral surface 642*a* is formed cutting out a corner portion of a roller main body 62*a* formed by the end surface 63 and an outer peripheral surface 64*a* to form a chamfer.

In the aforementioned roller main body 6*a* of the second embodiment, the entire outer peripheral surface 64*a* is formed by the same radius of curvature as the first outer peripheral surface 641, and a corner portion is cut out, and therefore, the second outer peripheral surface 642*a* can be formed. In other words, the second outer peripheral surface 642*a* can be easily formed simply by performing a simple process on the roller main body 62*a*.

Embodiments of the present invention were described above in detail while referring to the drawings, but the configurations of the embodiments and combinations thereof are merely examples, and additions, omissions, substitutions, and other changes may be made without deviating from the spirit and scope of the present invention. The present invention is not to be considered as being limited by the foregoing description but is only limited by the scope of the patent claims.

Note that in the aforementioned embodiments, the second outer peripheral surfaces 642, 642*a* were formed on both sides in an axial direction of the first outer peripheral surface 641, but is not limited thereto, and may be formed on at least one end portion in an axial direction of the first outer peripheral surface 641. The second outer peripheral surface 642, 642*a* is preferably formed on an end portion on a side near the inner end surface 63*a* in an axial direction, when formed on at least one end portion in an axial direction of the first outer peripheral surface 641.

INDUSTRIAL APPLICABILITY

According to aforementioned mill roller 6, the outer peripheral surface 64 has the second outer peripheral surface 642, and therefore, the roller main body 62 can be sufficiently brought closer to the mill table 4, and thus a required pulverizing performance can be achieved.

REFERENCE SIGNS LIST

1 Pulverizer
2 Housing
O1 Central axis line
21 Inlet port
22 Outlet port
3 Raw material supply tube
4 Mill table
40 Table shaft
41 Table surface
6,6*a* Mill roller
O2 Inclined axis line (axis)
61 Roller shaft
62, 62*a* Roller main body
63 End surface
63*a* Inner end surface
63*b* Outer end surface
64, 64*a* Outer peripheral surface
641 First outer peripheral surface
A Maximum Outer diameter point
642, 642*a* Second outer peripheral surface
7 Rotary separator
8 Imaginary curved surface

The invention claimed is:

1. A mill roller comprising:

a roller main body having an outer peripheral surface, the roller main body rotating about an axis line, and configured to pulverize an object to be crushed against a mill surface of a mill table wherein the outer peripheral surface comprises:

a first outer peripheral surface curved so as to form a convex shape outward in a radial direction orthogonal to the axis line of the roller main body, and having an arcuate shape formed with the same radius of curvature on both sides of a maximum outer diameter point formed about an axial direction of the outer peripheral surface in a cross section including the axis line; and a second outer peripheral surface formed on both ends in the axial direction of the first outer peripheral surface, connected to an end surface facing an axial direction of the roller main body, and receded further inward in the radial direction of an imaginary circle than an imaginary circle running along the first outer peripheral surface.

2. The mill roller according to claim 1, wherein each of the second outer peripheral surfaces is formed at a width of from 10% to 30% with regard to a width in the axial direction of the entire outer peripheral surface, in a cross section including the axis line.

3. The mill roller according to claim 1, wherein each of the second outer peripheral surfaces is curved so as to form a convex shape facing outward in a radial direction of the roller main body, and formed such that a roller curvature ratio which is a ratio of a radius of curvature with regard to a roller diameter which is a width in the axial direction of the roller main body is smaller than a roller curvature of the first outer peripheral surface.

4. The mill roller according to claim 3, wherein the roller curvature ratio of the first outer peripheral surface is 0.45 or less, and the roller curvature ratio of each of the second outer peripheral surfaces is 0.2 or less.

5. The mill roller according to claim 1, wherein each of the second outer peripheral surfaces forms a straight line shape in a cross section including the axis line.

6. A grinder, comprising:

the mill roller according to claim 1, and a mill table rotatably supported and pulverizing the object to be crushed between the mill surface and the outer peripheral surface of the mill roller.

* * * * *